US006874421B2

(12) United States Patent
Kitchin et al.

(10) Patent No.: US 6,874,421 B2
(45) **Date of Patent: *Apr. 5, 2005**

(54) INK JET TRANSFER PRINTING PROCESS

(75) Inventors: Jonathan P. Kitchin, Austin, TX (US); Joseph Clark Carls, Austin, TX (US); Dwight Lamar Evans, Cedar Park, TX (US); Steven Richard Austin, Oakdale, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/277,570

(22) Filed: Oct. 22, 2002

(65) Prior Publication Data

US 2003/0041750 A1 Mar. 6, 2003

Related U.S. Application Data

(63) Continuation-in-part of application No. 10/061,074, filed on Jan. 29, 2002.

(60) Provisional application No. 60/335,252, filed on Oct. 22, 2001, and provisional application No. 60/285,216, filed on Apr. 20, 2001.

(51) Int. Cl.[7] ..... B41F 1/16

(52) U.S. Cl. ..... 101/492; 101/34

(58) Field of Search ..... 101/33, 34, 217, 101/487, 488, 492, 35; 347/103; 446/220; 428/352, 42.1, 40.1; 156/557, 553

(56) References Cited

U.S. PATENT DOCUMENTS

| | | | |
|---|---|---|---|
| 1,567,132 | A | 12/1925 | Gill |
| 2,309,447 | A | 1/1943 | Greneker |
| 2,973,286 | A | 2/1961 | Ulrich |
| 3,026,648 | A | 3/1962 | Lemeleson |

(Continued)

FOREIGN PATENT DOCUMENTS

| | | |
|---|---|---|
| EP | 0 461 796 A1 | 12/1991 |
| EP | 0 756 947 A2 | 2/1997 |
| WO | WO 95/06564 | 3/1995 |
| WO | WO 95/21064 | 8/1995 |

(Continued)

OTHER PUBLICATIONS

*Satas, Ed., Handbook of Pressure Sensitive Adhesives, 2nd ed., Von Nostrand Reinhold 1989.

U.S. application entitled "Ink Jet Transfer Printing Process", filed Jan. 29, 2002, having U.S. Appl. No. 10/061,074, and which claims priority from U.S. Appl. No. 60/285,216, filed on Apr. 20, 2001.

U.S. application entitled "Ink Jet Transfer Printing Process", filed Oct. 22, 2002, having U.S. Appl. No. 10/061,847, and which claims priority from U.S. Appl. No. 60/335,252, filed Oct. 22, 2001.

*Primary Examiner*—Ren Yan
(74) *Attorney, Agent, or Firm*—Gregg H. Rosenblatt

(57) ABSTRACT

A method is provided for imparting images created with an inkjet printer to substrates. In accordance with the method, an image is imparted to an image receiving layer releasably disposed on a carrier sheet. An article can be provided, which is equipped with an adhesive patch on its surface. The image receiving layer is then brought into contact with the adhesive patch and, the carrier sheet is removed, thereby imparting an image to the substrate.

16 Claims, 3 Drawing Sheets

U.S. PATENT DOCUMENTS 3,897,587 A * 7/1975 Molner ..... 428/409
3,957,724 A 5/1976 Schurb et al.
3,976,075 A * 8/1976 Chinai et al. ..... 604/365
4,112,213 A 9/1978 Waldman
4,379,804 A 4/1983 Eisele et al.
4,567,073 A 1/1986 Larson et al.
4,595,931 A 6/1986 Toganoh et al.
4,872,414 A * 10/1989 Asquith et al. ..... 116/210
4,935,307 A 6/1990 Iqbal et al.
5,045,391 A 9/1991 Brandt et al.
5,108,865 A 4/1992 Zwaldo et al.
5,208,092 A 5/1993 Iqbal
5,264,275 A 11/1993 Misuda et al.
5,268,228 A * 12/1993 Orr ..... 428/343
5,290,615 A 3/1994 Tushaus et al.
5,296,277 A 3/1994 Wilson et al.
5,342,688 A 8/1994 Kitchin et al.
5,389,723 A 2/1995 Iqbal et al.
5,501,902 A 3/1996 Kronzer
5,650,215 A 7/1997 Mazurek et al.
5,670,557 A 9/1997 Dietz et al.
5,686,602 A 11/1997 Farooq et al.
5,721,086 A 2/1998 Emslander et al.
5,747,148 A 5/1998 Warner et al.
5,766,398 A 6/1998 Cahill et al.
5,795,425 A 8/1998 Brault et al.
5,795,636 A 8/1998 Keller et al.
5,798,179 A 8/1998 Kronzer
5,837,375 A 11/1998 Brault et al.
5,882,747 A * 3/1999 Bria et al. ..... 428/35.2
5,897,930 A 4/1999 Calhoun et al.
5,951,359 A * 9/1999 Prakopcyk et al. ..... 446/220
5,969,069 A 10/1999 Su et al.
6,001,482 A 12/1999 Anderson et al.
6,037,050 A 3/2000 Saito et al.
6,080,261 A 6/2000 Popat et al.
6,113,725 A 9/2000 Kronzer
6,124,417 A 9/2000 Su
6,153,038 A 11/2000 Brooker
6,165,593 A 12/2000 Brault et al.
6,197,397 B1 3/2001 Sher et al.
6,200,668 B1 3/2001 Kronzer
6,277,229 B1 8/2001 Popat et al.
6,435,935 B1 8/2002 Komaba
6,524,675 B1 * 2/2003 Mikami et al. ..... 428/40.1
6,558,789 B1 * 5/2003 Hamerski et al. ..... 428/343
6,630,049 B2 * 10/2003 Hannington et al. ..... 156/289
6,656,306 B1 * 12/2003 Mabbott ..... 156/230
2001/0031342 A1 10/2001 Engle et al.

FOREIGN PATENT DOCUMENTS

WO WO 95/23705 9/1995
WO WO 97/07991 3/1997
WO WO 97/42040 11/1997
WO WO 99/11727 3/1999
WO WO 99/12743 3/1999
WO WO 99/55537 4/1999
WO WO 9929511 6/1999
WO WO 99/56682 11/1999
WO WO 00/02735 1/2000
WO WO 00/11067 3/2000
WO WO 01/58697 8/2001
WO WO 01/58698 8/2001
WO WO 02/11994 2/2002
WO WO 02085644 10/2002
WO WO 03035406 5/2003

* cited by examiner

INK JET TRANSFER PRINTING PROCESS

CROSS-REFERENCE TO RELATED APPLICATIONS

This application is a continuation-in-part of U.S. Ser. No. 10/061,074, filed on Jan. 29, 2002, which claims priority to U.S. Provisional Application Ser. No. 60/285,216, filed on Apr. 20, 2001, and claims priority to U.S. Provisional Application Ser. No. 60/335,252, filed on Oct. 22, 2001, which are incorporated herein by reference in their entirety.

FIELD OF THE INVENTION

The invention relates generally to methods for imparting graphics to a substrate, and in particular to methods for imparting graphics to low rigidity substrates.

BACKGROUND OF THE INVENTION

In recent years, foil balloons have grown in popularity for festive occasions in comparison with traditional latex balloons. Foil balloons, unlike latex balloons, may be manufactured with a decorative, metallized finish, and are readily printed during manufacture with colorful graphics using conventional methods such as flexography or silkscreen. Foil balloons of various designs are currently available at most greeting card stores.

The greeting card industry has shown a strong trend as of late toward customization. Thus, for example, many greeting card stores feature equipment that allows patrons to produce customized greeting cards on the premises. This interest has extended to other items sold by the industry, including decorative foil balloons. However, flexography, silk screen, and the other printing techniques commonly used by the industry to produce decorative foil balloons are generally limited to large scale production, and do not lend themselves to small scale, customized production of the type required for customized or personalized items.

Some attempts have been made to develop methods for the production of customized foil balloons. Thus, for example, PCT Intl. Pub. No. WO 00/11067 (Lang) discloses methods for producing decorative foil balloons through the use of a conventional ink jet printer. In accordance with the methodology disclosed therein, the surface of the foil is first adapted for printing by having a surface coating applied thereto. The balloon is then fed through a conventional inkjet printer which is set up to print a design on the adapted surface of the foil.

However, the approach of WO 00/11067 (Lang) suffers from a number of serious drawbacks. For example, foil balloons are typically constructed from very thin caliper foils so that they will be suitably buoyant, and hence tend to have very little rigidity. Consequently, when a foil balloon is fed through a conventional inkjet printer, it tends to wrap around the drums, rollers and other feeding mechanisms of the printer, thereby causing the printer to jam.

WO 00/11067 (Lang) also notes that the balloon may be wrapped around, or adhered to, a rigid substrate such as card sheet to facilitate printing. However, this approach suffers from the drawback that such a substrate tends to jam the feeding mechanisms of conventional printers, which are designed for feeding paper sheets of ordinary caliper. The approach of WO 00/11067 (Lang) also assumes that the uninflated balloon can be pressed into a flat or smooth surface suitable for printing, and thus places limitations on the size and geometry of the balloon and on the way that the balloon is compressed for storage or shipping. Moreover, the approach of WO 00/11067 (Lang) is not applicable to inflated balloons.

Transfer ink jet printing methods are well known and involve printing onto a temporary carrier sheet from which the image is subsequently transferred, by lamination, to the final substrate. Transfer printing systems are described, for example, in U.S. Pat. No. 5,501,902 (Kronzer), U.S. Pat. No. 5,798,179 (Kronzer), U.S. Pat. No. 6,113,725 (Kronzer), and U.S. Pat. No. 6,200,668 (Kronzer). In such a system, an ink jet receptive layer may be combined with a thermally activated adhesive on a temporary supporting sheet. After imaging, the receptor layer, including the image, is transferred under the influence of heat and pressure to the final substrate. However, the use of a thermally activated adhesive is a requirement of such systems, since the sheet must pass through a printer without adhering to the feed mechanism. Since foil balloons are temperature sensitive and tend to distort and shrivel at elevated temperatures, this requirement precludes the use of this technique for transfer to foil balloons.

Some ink jet transfer printing systems have also been described whereby a thermally activated adhesive is coated on the article that is to receive the final image. A system of this type is described, for example, in U.S. Pat. No. 5,766,398 (Cahill et al.). However, this approach suffers from the infirmities noted above in that the use of a thermally activated adhesive precludes its use on temperature sensitive substrates such as foil balloons.

A room temperature transfer system has been described in U.S. Pat. No. 6,153,038 (Brooker). In accordance with the methodology disclosed therein, an image is first printed on a non-adsorbent medium such as transparency film, as through the use of a conventional inkjet printer. The image is then imparted to the target substrate by bringing the surface bearing the image into contact with the target substrate with the application of pressure. The target substrate may be provided with a material that will adhere to the surface of the substrate and is sufficiently absorbent, porous, or abrasive such that it will properly receive the ink image.

The approach suggested in U.S. Pat. No. 6,153,038 (Brooker) is advantageous in that it does not require the application of heat (only pressure), and can therefore be used to print onto a temperature sensitive substrate. Moreover, the substrate to which the image is to be imparted does not itself have to be passed through the inkjet printer, thus avoiding many of the problems noted above. However, this approach is undesirable in that the printing of the image on the non-adsorbent medium allows the ink to coalesce before the image is imparted to the target substrate, thereby resulting in blurring of the image and an overall reduction in image quality. Moreover, any lateral motion of the non-adsorbent medium during the image application process will cause the image to be smeared. Hence, this approach is not very user friendly and is not suitable where high image quality is desirable.

An alternative method of cold image transfer has been disclosed in U.S. Pat. No. 6,277,229 (Popat et al.) whereby the imageable layer on a transfer sheet comprises a water activated adhesive that is rendered tacky by application of the inkjet ink. Transfer occurs only in those areas that have been activated by the ink. As with other wet transfer techniques, however, this procedure is prone to smudging of the image during the transfer process.

There is thus a need in the art for a method for imparting graphics to foil balloons and to other temperature sensitive substrates and articles, and which can be used in conjunction with conventional inkjet printers. There is also a need in the art for a method for imparting graphics to foil balloons which can be used with balloons having virtually any geometry. These and other needs are met by the present invention, as hereinafter described.

SUMMARY OF THE INVENTION

Figure 1:
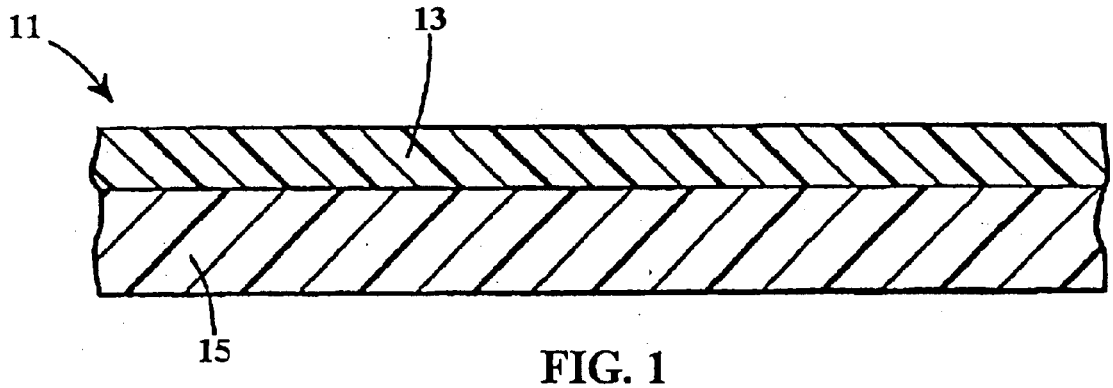
FIG. 1 is a schematic illustration of an image transfer sheet suitable for use in the methodology of the present invention.

In one aspect, the present invention relates to a method for imparting graphics to substrates, and to products made in accordance with this methodology. In accordance with the method, an image transfer sheet comprising an image receptor layer is coated onto a temporary carrier sheet. The transfer sheet is then imaged by conventional ink jet printing. A substrate or an article containing a substrate, is provided with at least one patch of pressure sensitive adhesive which preferably corresponds in size and shape to the image transfer sheet. The adhesive patch is preferably protected from contact prior to use by a releasable backing sheet. Transfer of the image to the substrate is carried out by removal of the protective backing sheet from the adhesive patch, followed by lamination of the image transfer sheet, image side down, to the adhesive patch. After application of moderate pressure, the temporary carrier sheet is peeled away, leaving the imaged layer in place on the substrate. Preferably, the adhesive patch is structured with surface indentations or protrusions that facilitate removal of air or gas pockets which may be formed during the lamination process. In embodiments where the substrate is a balloon, the gas pockets may be formed by the egress of helium or other gases through the foil body of the balloon after the imaged layer is in place. In embodiments where the substrate is a balloon, it is also preferred that the balloon is manufactured such that the combined weight of the adhesive patch and the image bearing layer is sufficiently counterbalanced (e.g., by asymmetries in the weight distribution of the balloon construction) to enable the balloon to float essentially upright when it is inflated.

In another aspect, the present invention relates to an article, such as a foil balloon, which is adapted to receive an image. The article is provided with a surface, at least a portion of which is coated with an adhesive adapted to receive an image-bearing layer from a temporary carrier sheet. The adhesive may be covered with a release liner to facilitate handling. In use, an image-bearing layer is formed by passing an image transfer sheet, which comprises an image receptor layer, releasably disposed on a carrier sheet, through an inkjet printer or other image forming means. The image-bearing layer is then brought into contact with the adhesive. The adhesive coating is preferably structured with surface indentations or protrusions that facilitate removal of air or gas pockets which may be formed during the lamination process or by the egress of helium or other gases through the foil body of the balloon after the imaged layer is in place. Since the image bearing layer bonds more strongly to the adhesive than to the carrier sheet, the image-bearing layer remains affixed to the adhesive when the carrier sheet is removed, thereby imparting the image to the article. Preferably, the balloon is manufactured such that the combined weight of the adhesive patch and the image-bearing layer is sufficiently counterbalanced (e.g., by asymmetries in the weight distribution of the balloon construction) to enable the balloon to float essentially upright when it is inflated.

In another aspect, the present invention relates to a kit, comprising at least one article containing a substrate having a pressure-sensitive adhesive disposed on a surface thereof, and one or more image transfer sheets, said image transfer sheets comprising an image receptive layer releasably adhered to a carrier sheet. The kit may be used to generate customized articles in accordance with the present invention.

In yet another aspect, the present invention relates to a kit, comprising at least one balloon having a pressure sensitive adhesive disposed on a surface thereof, and one or more image transfer sheets, said image transfer sheets comprising an image receptive layer releasably adhered to a carrier sheet. The kit may be used to generate customized balloons in accordance with the present invention.

DETAILED DESCRIPTION OF THE PREFERRED EMBODIMENT

Overview

The present invention provides a method for imparting graphics to substrates, or articles comprising a substrate, including, for example, foil balloons and other non-rigid substrates. In some embodiments, these articles cannot easily be fed through a common inkjet printer. Substrates especially adapted for use with the method can also be provided. The method makes advantageous use of an image transfer sheet, one embodiment of which is depicted in FIG. 1. The image transfer sheet 11 comprises an image receptor layer 13 releasably coated onto a temporary carrier sheet 15. The temporary carrier sheet 15 has sufficient release properties such that the image receptor layer 13 will release from it without tearing when the image receptor layer 13 is brought into contact with a tacky substrate, such as a substrate treated with an adhesive, but at the same time adheres sufficiently to the image receptor layer 13 so that the image transfer sheet as a whole will not undergo delamination during normal handling. The temporary carrier sheet 15 is also preferably selected to provide suitable rigidity and other desirable physical characteristics to the overall construction, for example, to provide reliable feeding through common ink jet printers.

Figure 2:
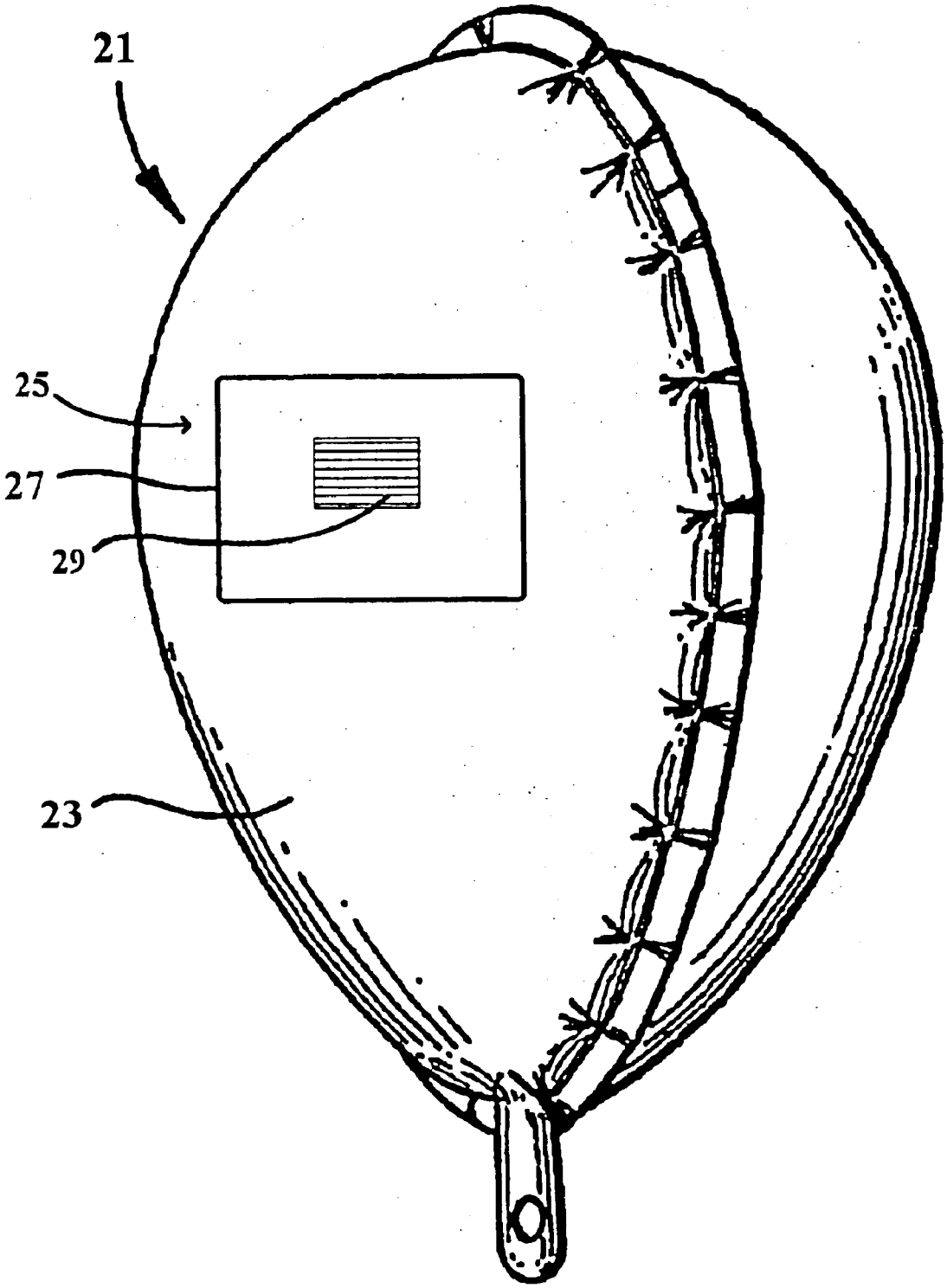
FIG. 2 is a perspective view, partially in section, of a foil balloon suitable for use as a target substrate in the methodology of the present invention.

FIG. 2 depicts one particular example of a balloon 21 which is suitable for use as a target substrate in the present invention. The balloon 21 comprises a metallized foil skin 23 which is equipped on its surface with an adhesive patch 25. The adhesive patch 25 is covered with a release liner 27 to facilitate handling prior to printing. The adhesive patch 25 is preferably structured with surface indentations or protrusions that facilitate removal of air or gas pockets which may be formed during the lamination process or by the egress of helium or other gases through the foil body of the balloon 21 after the imaged layer is in place. Such protrusions or indentations may take the form, for example, of a series of fine grooves 29 on the outer surface of the adhesive patch 25 (the adhesive patch 25 is shown in FIG. 1 with a portion of the overlying release liner 27 removed to illustrate this feature).

Figure 3:
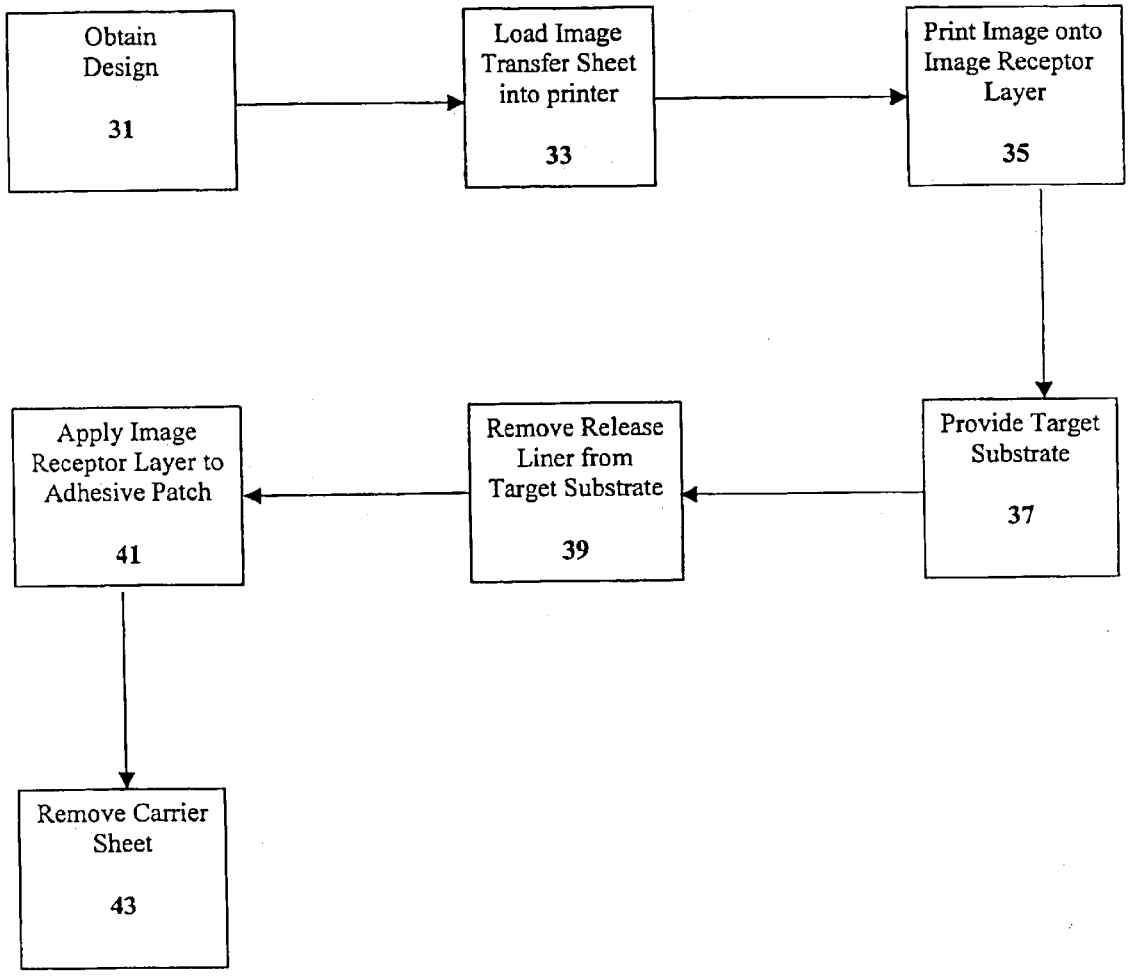
FIG. 3 is a flowchart illustrating one embodiment of the methodology of the present invention.

A particular example of the methodology of the present invention is depicted in FIG. 3, it being understood that many variations of this methodology are possible within the scope of the present invention. In accordance with the method depicted in FIG. 3, a user creates or provides an image or design 31 which is to be imparted to a target substrate and which is printable by an inkjet printer, a laser printer, or other conventional printing means. The image transfer sheet 11 is loaded into the printer 33, and the image or design is then printed onto the image receptor layer 35. Next, a target substrate, such as the balloon 21 depicted in FIG. 2, is provided 37. The release liner 27 is removed from the target substrate 39 to expose the adhesive patch 25, and the image receptor layer 35 is brought into contact with the adhesive patch 41, preferably with slight to moderate pressure. Since the image receptor layer 35 bonds more strongly to the adhesive than to the temporary carrier sheet 15, it remains bonded to the target substrate when the temporary carrier sheet 15 is removed 43, thereby imparting an image to the target substrate.

Image Transfer Sheets

Image transfer sheets suitable for use in this invention comprise an image receptor layer which is releasably attached to a carrier sheet. Suitable image transfer sheet constructions include those described, for example, in PCT Intl. Pub. No. WO 00/02735 (Dinkel et al.), which is incorporated by reference herein in its entirety. The various components of these image transfer sheets are described in greater detail below.

Image Receptor Layer

The image receptor layers used in the image transfer sheets of the present invention can be a single layer or a laminate of two or more layers. While the descriptions of some of the embodiments of the image receptor layer herein refer to two layers (namely, a bottom surface layer and a top surface layer), it is to be understood that the properties of both layers could be combined into a single layer, or could be further separated into a greater number of layers. Generally, however, the image receptor layer should have a bottom surface capable of providing appropriate release properties to the carrier sheet, and a top surface capable of receiving an image. In the case of multiple layer image receptive coatings, the layer that is contiguous with the carrier sheet may serve the purpose of a protective outer layer after the image is transferred. Such a construction is described, for example, in U.S. Pat. No. 5,766,398 (Cahill et al.).

Bottom Surface Layer of Image Receptor

The bottom surface layer of the image receptor layer can be constructed from a variety of compositions, and is selected such that it can release from the carrier sheet under normal conditions of use while at the same time adhering to the carrier sheet sufficiently well so that it does not undergo premature delamination during handling. Compositions suitable for use in this layer include those disclosed in U.S. Pat. No. 4,379,804 (Eisele et al.); U.S. Pat. No. 4,935,307 (Iqbal et al.); U.S. Pat. No. 5,045,391 (Brandt et al.); U.S. Pat. No. 5,108,865 (Zwaldo et al.); U.S. Pat. No. 5,208,092 (Iqbal); U.S. Pat. No. 5,342,688 (Kitchin et al.); U.S. Pat. No. 5,389,723 (Iqbal et al.); and U.S. Pat. No. 5,747,148 (Warner et al.). Some specific, non-limiting examples of these materials include poly(vinylpyrrolidone), copolymers of vinylpyrrolidone (e.g., with ethylene or styrene), poly(vinyl alcohol), polyacrylic acids, polymethacrylic acids or (1-alkyl) acrylic acid copolymers and the inorganic salts thereof (such as the alkali metal salts), poly(alkylene oxides) or polyglycols, carbohydrates, alkyl and hydroxyalkyl cellulose derivatives, starch and starch derivatives such as hydroxyalkyl starches, carboxyalkyl celluloses and their salts, gum arabic, xanthan gum, carageenan gum, proteins and polypeptides. The bottom surface layer of the image receptor may also comprise a water-insoluble polymer such as a polyolefin, polyacrylate, polyester, polyamide, or polyurethane.

Top Surface Layer of Image Receptor

The top surface layer of the image receptor can be constructed from a variety of compositions, provided it can adhere to a receiving substrate under appropriate transfer conditions and can receive an image. The top surface layer may include various ink jet receptive coatings as are known in the art, such as the compositions called ink jet receptor layers in U.S. Pat. No. 5,747,148 (Warner et al.). Suitable image receptor coatings may be of the microporous or swellable polymer type. Microporous image receptor coatings, and in particular ink jet receptive coatings, are described, for example, in U.S. Pat. No. 5,264,275 (Misuda et al.) and U.S. Pat. No. 6,037,050 (Saito et al.), and typically include one or more composite layers comprising a binder material and inorganic particles such as silica or alumina. The particles are arranged in the binder material such that voids between the particles provide porosity.

Swellable polymer type ink jet receptive coatings may also be used in the image receptor layer of the present invention. Such materials are described, for example, in U.S. Pat. No. 5,342,688 (Kitchin et al.) and U.S. Pat. No. 5,389,723 (Iqbal et al.). Swellable polymer type ink jet receptive coatings typically comprise one or more hydrophilic polymers such as gelatin, polyvinyl alcohol, polyvinylpyrrolidone, copolymers of vinyl pyrrolidone (e.g., with ethylene or styrene), poly(vinyl alcohol), polyacrylic acid derivatives, (1-alkyl) acrylic acid copolymers and the inorganic salts such as alkali metal salts derived therefrom, cellulose derivatives, including alkyl and hydroxylalkyl cellulose derivatives, polysaccharides, carbohydrates, starch and starch derivatives such as hydroxyalkyl starches, carboxyalkyl celluloses and their salts, gum arabic, xanthan gum, carageenan gum, proteins and polypeptides, poly (alkylene oxides), polyethylene oxides, polyglycols, and polyalkyloxazolines.

Swellable polymer coatings used in the top surface layer may optionally be cross-linked by a chemical or physical cross-linking agents, and may contain additional additives such as inorganic or organic matting agents, quaternary ammonium salt dye fixing agents (mordants), surfactants, humectants, biocides, fillers, UV absorbers, image dye stabilizers, and other such additives.

The dried thickness of the ink absorptive layer is typically within the range of about 3 to about 50 microns, and most preferably is within the range of about 8 to about 25 microns.

As noted above, the top surface layer can include dispersed particles or particulates according to the disclosure of U.S. Pat. No. 5,747,148 (Warner et al.). Non-limiting examples of such dispersed particles or particulates include corn starch or modified corn starches, silica, alumina, titanium dioxide or other white inorganic oxide or hydroxide materials, cotton or flock particles and other cellulose or modified cellulose particulates, calcium carbonate or calcium silicate and other white inorganic silicates, sulfides and carbonates, clays, and talc. The size of the dispersed particles or particulates are typically in the range of approximately 1 to 40 micrometers in diameter, and preferably in the range of approximately 2 to 20 micrometers in diameter. However, the present invention is not particularly limited to any range of particle sizes, so long as there are sufficient particles having sizes large enough to roughen the upper surface of the top surface layer. Dried top surface layer coating weights are typically within the range of about 2 to about 30 g/m$^2$. Preferred coating weights are within the range of about 5 to about 20 g/m$^2$.

Carrier Sheet

A variety of conventional carrier sheets can be used in practicing the methodology of the present invention. The carrier sheet may be a sheet of any material that has suitable flexibility and rigidity to pass, unsupported, through the feed mechanism of common ink jet printers. Suitable carrier sheets typically have a thickness within the range of about 50 to about 300 microns, and most preferably have a thickness within the range of about 75 to about 150 microns. The carrier sheet is preferably constructed such that the adhesion between the carrier sheet and the contiguous image receptor layer is sufficiently low to allow ready removal of the image receptor layer, and to allow transfer of the image receptor layer to a pressure sensitive adhesive layer. This may be accomplished through appropriate selection of the carrier sheet materials or the materials of the bottom layer of the image receptor. Non-limiting examples of suitable carrier sheets include coated (alkyd and acrylic) and uncoated paper liners, paper laminates, and plastic films, including those comprising polyester, polystyrene, polyethylene, polypropylene, and other polyolefins.

In some embodiments of the present invention, the backside of the carrier sheet (the side opposite from the surface with the receptor coating) may also be provided with a release layer to prevent transfer of the receptor coating from the carrier front side of the image transfer sheet to the backside when the image transfer sheet is stored in roll form.

There is no particular limit to the area of temporary carrier sheet. However, for most practical applications, the width of the carrier sheet will be within the range of about 2 cm to about 2 m.

While the carrier sheet will typically be removed from the target substrate and subsequently discarded, the present invention also contemplates embodiments wherein the carrier sheet is permanently bonded to the image receptor layer and serves as a protective covering after the image receptor layer is installed on the target substrate. In such embodiments, the carrier sheet will preferably be sufficiently transparent or translucent so as to give effect to the printed design or image. In these embodiments, the carrier sheet may also be designed to serve numerous other functions. Thus, for example, the carrier sheet can be made to serve as a layer which protects the pattern or image from abrasion, moisture, UV degradation, and other effects. The carrier sheet may also be fashioned as a polarizer, mirror (either a broadband or color mirror), or diffuser, or may be selected to give the image or pattern a gloss, semi-gloss, or matte finish.

Receiving Substrate

Figure 4:
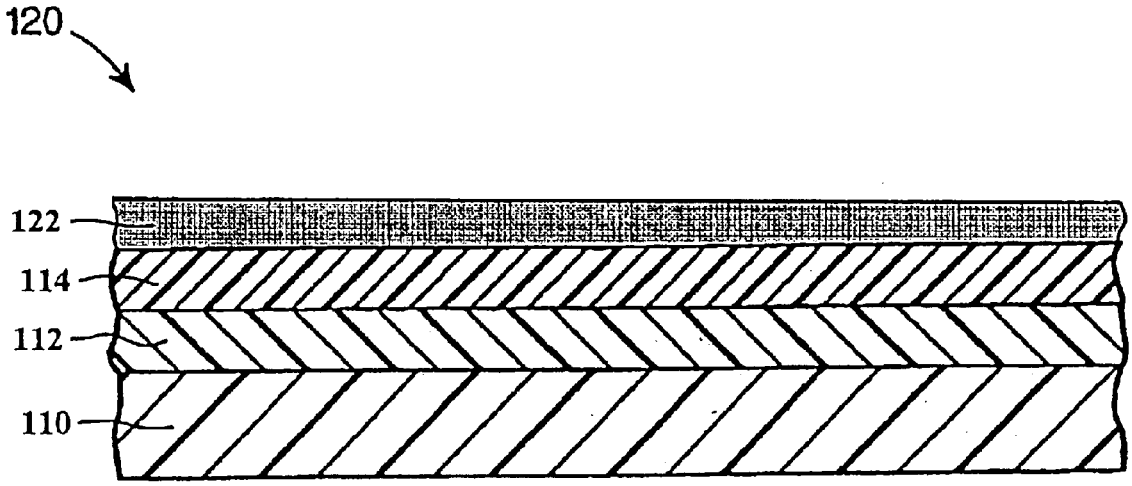
FIG. 4 is a cross-sectional view of a substrate imprinted in accordance with the present invention.

FIG. 4 shows a cross-sectional view of an imprinted substrate 120 produced in accordance with the method of the present invention. The imprinted substrate comprises a receiving substrate 122 having disposed thereon the top surface layer 114 and the bottom surface layer 112 from the temporary carrier sheet 110.

The receiving substrate can be any single layer or multilayer composite according to the requirements of use. The receiving substrate may comprise a polymeric film coated on a major surface with a pressure sensitive adhesive, which in turn is protected by a release liner.

Non-limiting examples of receiving substrates suitable for use in the practice of the present invention include cellulosic substrates, including naturally and synthetically-modified cellulosics polyvinyl chlorides, solid and microvoided polyesters, polyolefins, polycarbonates, polyacrylates, polyacrylate esters, and copolymers thereof, including ionomers (e.g., SURLYN™ brand ionomer from DuPont of Wilmington, Del., USA), metal foils such as aluminium foil, plastic films and sheeting, latex substrates, leathers, plastics, wood (finished or unfinished), ceramic, glasses, or composites thereof. Examples of modified-polyolefins suitable for use in the present invention are disclosed in U.S. Pat. No. 5,721,086 (Emslander et al.). Any of these substrates may take a variety of forms, or be contained on a number of articles, examples of which articles can either be substantially two-diminensional or three-dimensional.

As noted above, the methodology of the present invention is particularly suitable for the transfer of images to foil balloons. Such balloons may be fabricated from any suitable thin foil material. A composite foil comprising aluminum and a polymer film is commonly used. Preferably, the balloon is manufactured such that the combined weight of the adhesive patch and the image-bearing layer is counterbalanced (such as, for example, by asymmetries in the weight distribution of the balloon construction), thus enabling the balloon to float essentially upright when it is inflated.

To facilitate the practice of the present invention, two or more items suitable for implementing the methodology of the present invention may be grouped together and sold as a kit. Thus, for example, a balloon prepared in accordance with the invention may be sold in conjunction with one or more image transfer sheets of the type described herein. In another embodiment, a kit including an article containing a substrate prepared in accordance with the invention may be sold in conjunction with one or more image transfer sheets of the type described herein.

Adhesive Patch on Receiving Substrate

In accordance with the present invention, an adhesive patch is provided on the surface of the article, for example, a balloon. Preferably, this patch corresponds in size to the image that is to be transferred. In some embodiments, multiple patches may be provided on one or both outer surfaces of the article, and these patches may have various shapes and sizes.

The adhesive patch preferably comprises a suitable pressure sensitive adhesive, which may be defined as a material which adheres using applied finger pressure and which is permanently tacky. Pressure sensitive adhesive formulations are described, for example, in Satas, Ed., "Handbook of Pressure Sensitive Adhesives", 2$^{nd}$ Ed., Von Nostrand Reinhold 1989, and in U.S. Pat. Nos. 2,973,826, 4,112,213 (Waldman) and U.S. Pat. No. 5,670,557 (Dietz et al.). Pressure sensitive adhesives typically comprise an elastomeric polymer such as natural or synthetic rubber, acrylic polymers and copolymers, or styrene butadiene copolymers. The adhesive composition typically contains one or more of the following additives: tackifying additives, cross-linking agents, fillers, antioxidants and stabilizers.

The pressure sensitive adhesive may be applied to the substrate as a liquid coating which is sabsequently dried. The liquid coating of adhesive may, for example, be sprayed or brushed onto a balloon. A suitable spray adhesive is available from 3M Co. under the brand name PHOTO MOUNT® spray adhesive. The liquid coating of adhesive coating may also be applied to the substrate by a printing process such as printing, flexographic printing or gravure printing. Printable adhesive compositions are disclosed, for example in PCT Intl. Pub. No. WO 99/11727 (Banovetz at al). The adhesive may be printed as a continuous layer or as discrete dots separated by narrow channels. However, the preferred method of application of the adhesive patch to the substrate is by transfer of adhesive layer that is precoated on a releasable backing sheet. Suitable examples of a coated adhesive layer on releasable backing sheet are available from 3M Co. under the brand-name SCOTH® adhesive transfer tape.

In embodiments where the substrate is a balloon, in order to permit convenient packaging and handling of the balloon, a releasable backing sheet is applied to the adhesive prior to use. If the adhesive is applied using an adhesive transfer tape, the releasable backing sheet that is supplied with the adhesive may simply be left in place until the balloon is used to transfer the printed image. Releasable backing sheets, also known as release liners, are well-known and are available from a number of sources. Examples of suitable releasable backing sheet materials for use in the present invention include silicone coated kraft paper, silicone coated polyethylene paper laminates, and the like. In some cases, improved release from the adhesive layer may be achieved by further treatment of the releasable backing sheet with polymeric release agents such as silicone urea resins, urethanes and long chain acrylates, described, for example, in U.S. Pat. Nos. 3,957,724 (Schurb et al.), U.S. Pat. No. 4,567,073 (Larson et al.) and U.S. Pat. No. 5,290,615 (Tushaus et al.).

Preferably, a relief structure of indentations or protrusions is provided on the outer surface of the adhesive. Such a structure provides fine channels to facilitate the removal of air or gas pockets which may be formed during the lamination process or by the egress of helium or other gases through the foil body of the balloon after the imaged layer is in place. The surface structure on the adhesive is most conveniently provided by embossing the releasable backing sheet with the complementary relief pattern. So long as the adhesive is capable of retaining an impression (a characteristic which may be imparted to the adhesive by an appropriate amount of cross-linking or by other means as are known to the art), the surface of the adhesive in contact with the releasable backing sheet will assume the desired surface structure.

The surface structure of the adhesive can have various morphologies, but is preferably in the form of a series of grooves. Such grooves may be in the form of parallel lines or a cross-hatched pattern which is disposed on the surface of the adhesive. Spacing of the surface features is typically within the range of about 5 to about 300 features per inch, and preferably within the range of about 10 to about 150 features per inch. Adhesive coatings that exhibit surface structures which facilitate the removal of air or gas pockets are described, for example, in U.S. Pat. No. 5,650,215 (Mazurek et al.), U.S. Pat. No. 6,197,397 (Sher et al.), U.S. Pat. No. 5,897,930 (Calhoun et al.) and U.S. Pat. No. 5,795,636 (Keller et al.).

By appropriate selection of the adhesive, it is possible to maintain a structure of open microchannels on the surface of the adhesive even after the adhesive has been laminated to a substrate (in this case, the image-bearing receptor layer). By this means, channels for the egress of gas from the adhesive/image layer boundary can be maintained for months after the image has been laminated to the balloon. This property has been found to be surprisingly advantageous in the case of images laminated to foil balloons that are subsequently filled with helium. Very small molecules, such as helium, are able to diffuse through the thin walls of foil balloons at a relatively rapid rate. In the absence of microchannels, helium and other gases which diffuse through the wall of the balloon collect at the adhesive/image layer boundary. Such gases tend to delaminate the image layer from the adhesive over a period of time, causing unsightly blisters beneath the image layer. Therefore, it is preferred that the adhesives used in the practice of the present invention are capable of maintaining open microchannels at the interface of the adhesive and the image receptor layer after lamination of the adhesive to the image. Suitable adhesives for this purpose, which are typically crosslinked to minimize flow, are discussed in U.S. Pat. No. 6,97,397 (Sher at al.).

Inks

A wide variety of inks may be used in practicing the methodologies of the present invention. These include those inks commonly available from printer manufacturers for conventional ink jet printing. Such inks commonly comprise a liquid carrier, dyes or pigments, humectants, organic solvents, biocides, and agents to control rheology and surface tension. The inks may or may not be water-soluble. Suitable inks include high pigment density inks which allow for brighter colors without the need to apply heavy or multiple coats. Suitable inks also include high viscosity inks Image Sources The images to be imparted to the balloons and other substrates in acordance with the present invention may come from a variety of sources. Thus, for example, the images may be input into a computer through the use of a scanner, by the use of a digit camera, by downloading an image from a remote source (such as from a disk, a network, or the Internet), or by creating a new image on the computer through the use of an appropriate software package. Prior to printing the selected image onto the image receiving layer, the image may be manipulated, as by adjusting the brightness, colors, contrast, orientation, size, background, foreground, shape and various other visual attributes of the image prior to printing. A variety of image manipulation computer programs are available that are suitable for these purposes. These include, for example,ADOBE® PAGEMAKER®,ADOBE® PHOTOSHOP®, ADOBE®ILLUSTRATOR®, SCOTHPRINT® Graphic Maker Ink Jet Software (available from Minnesota Mining and Manufacturing Company, St. Paul, Minn.), PHOTOSMART (available from Hewlett Packard Co., Palo Alto, Calif.), Hemera Graphics Desk for HP, Corel PHOTO HOUSE™ 5, and the like.

Sealants

A variety of sealant compositions may be used in the methodology of the present invention to protect the image that has been imparted to the target substrate. These compositions may protect the image from abrasion, moisture or humidity, UV degradation, or fingerprints, and may also prevent the image from retransferring to other objects. These compositions may also be used advantageously to manipulate the finish of the image, thereby providing an image with a finish that is flat, semi-gloss, gloss, or satin. The exact choice of sealant compositions will depend, in part, on the inks used, the materials of the image receiving layer, and/or the target substrate. However, examples of such compositions include KRYLON® 1312 spray, also referred to as Kamar Varnish, available from KRYLON® Products Group, Specialty Division, of the Sherman Williams Co. of Solon, Ohio.

Printing Devices and Methodologies

A variety of a printing devices and methodologies maybe used to impart an image to the image receiving layers in accordance with the present invention. These include, for example, flexography and silkscreen methodologies. However, the preferred methedology for imparting an image to the image receiving layer is through the use of conventional printers, such as ink jet printers or laser printers, or such other printers as are capable of printing a black and white, single color, or full-color image. Examples of suitable ink jet printers in include Hewlett Packard DeskJet ink jet printers, Canon Bubble lot ink jet printers, LEXMARK® ink jet printers, and Epson ink jet printers.

While the method of printing an image onto a foil balloon or similar object in accordance with the present invention can vary significantly, the following are the steps involved in a typical embodiment:

A mirror image of the desired graphic is printed onto the image receptor/ink absorptive layer side of the image transfer sheet, using an ink jet printer.

The image is optionally allowed to dry for up to 30 minutes, either at room temperature or using hot air.

The releasable backing sheet is peeled away and removed from the adhesive patch on the balloon.

The printed side of the image transfer sheet is applied to the exposed adhesive.

The balloon and image transfer sheet are firmly laminated together by hand or, optionally, with mechanical pressure as through the use of a roller or squeegee.

The temporary carrier sheet is peeled away from the ink absorptive layer and removed.

The present invention shall now be illustrated by reference to the following non-limiting examples.

EXAMPLE 1

This example illustrates the preparation of an image transfer sheet in accordance with the present invention.

A solution of the following components was coated onto a temporary carrier sheet of 100 microns thick unprimed polyethylene terephthalate film and dried using blown air at 160° C. The coating weight of the dried layer was 10.7 g per square meter.

| Coating composition (percent by weight): | |
|---|---|
| water | 90% |
| polyethylene oxide (200,000 molecular weight) | 0.8% |
| hydroxypropylmethyl cellulose | 5.5% |
| colloidal hydrated alumina | 2.4% |
| sorbitol | 1.0% |
| mordant[1] | 0.3% |

[1]The mordant is the compound identified as P. 134-Cl in U.S. Pat. No. 5,342,688 (Kitchin et al.).

The adhesion of the dried coating to the polyethylene terephthalate was sufficient that the coating remaining adhered during normal handling, including cutting of the composite into 8.5×11 sheets, but the coating was readily removed as an into layer by application of a short length of 3M SCOTCH™ brand MAGIC™ tape to the surface of the coating, followed by removal of the tape.

EXAMPLE 2

This example illustrates the preparation of an image receptive balloon.

An 18 inch diameter aluminized foil balloon, manufactured by Anagram International Inc. of Minneapolis, Minn. was laid out on a fist surface. An 8.5×11 inch rectangular sheet of 3M SCOTCH™ brand 9457 Hi-tack Acrylic laminating Adhesive was adhered to the exposed side of the balloon, using firm hand pressure. The releasable backing sheet was left in place covering the adhesive.

EXAMPLE 3

This example illustrates preparation and transfer of an image in accordance with the present invention.

An 8.5×11 inch sample of image transfer sheet, prepared as described above, was imaged on the ink absorptive layer side with a color test pattern using a Hewlett-Packard 2500C ink jet printer. The mirror image option was selected on the printer. The printed image was allowed to dry for five minutes. The releasable backing sheet was removed from the balloon of EXAMPLE 2. The image side of the image transfer sheet was pressed into contact with the adhesive patch on the balloon using firm hand pressure. The releasable backing sheet was then peeled away from the image and discarded. A high-quality image remained in place on the balloon.

EXAMPLE 4

A polyethylene and silicone coated paper release liner was embossed to form a microstructured surface on the coated side according to the process described in U.S. Pat. No. 6,197,397 (Sher et al.), which is incorporated herein by reference. An embossed pattern was used which consisted of a series of raised walls, of trapezoidal cross-section, in a square cross-hatched array at a frequency of 20 walls per inch. The walls were approximately 130 microns wide at the base, narrowing to approximately 27 microns wide at the top, and extending approximately 26 microns in height above the flat surface of the release liner. A crosslinked pressure sensitive adhesive consisting of 93% isooctylacrylate and 7% acrylic acid, described as "adhesive solution 5" of U.S. Pat. No. 5,296,277, (Wilson et al), was cast onto the embossed side of the release liner. A polyethylene cover film was applied temporarily to protect the adhesive prior to its application to one side of a deflated foil balloon.

A sample of the microstructured adhesive and release liner, described above, was applied to a foil balloon such that the embossed liner remained in place and covered the adhesive patch. The adhesive patch itself was firmly bonded to the surface of the balloon. The release liner was then peeled away, exposing the microstructured surface of the adhesive. The pattern on the adhesive surface was an array of grooves or micro-channels complementary in shape to the pattern embossed onto the release liner.

An imaged transfer sheet was prepared as described in Examples 1 and 3, and laminated, in this case, to the structured-surface adhesive. Using light hand pressure and motion, small bubbles of air trapped between the adhesive and the transfer sheet were readily smoothed away by virtue of the micro-channel array on the adhesive surface. The carrier sheet was then peeled away from the image layer. In comparison to the result of EXAMPLE 3, lamination proved to be significantly more convenient due to the ease of bubble removal. Very fine channels, corresponding to the original microstructure of the adhesive surface, remained visible after lamination of the image layer. The resulting image was found to be more attractive than that of EXAMPLE 3, owing to the complete absence of entrapped air bubbles beneath the image.

EXAMPLE 5

The image-bearing balloons produced in EXAMPLES 3 and 4 were filled with helium and kept in a normal office environment (71° F., 50% Relative Humidity) for 48 hours. Close inspection of the balloons revealed the appearance of blisters on some areas of the image on the balloon of EXAMPLE 3 (which utilized a smooth surface adhesive) subsequent to lamination. However, no such blemishes were visible on the balloon of EXAMPLE 4 which had been produced using a microstructured surface adhesive, and which maintained open microchannels for the egress of gas out from under the image after lamination.

EXAMPLE 6

A helium filled balloon, produced in accordance with EXAMPLE 3, was tied to a 3 foot length of light ribbon and secured to a fixed object. No attempt was made during manufacture of the balloon to balance the extra weight present on one side of the balloon through the addition of the adhesive and image bearing layer. Consequently, the balloon floated at an angle of approximately 15 degrees from vertical. The experiment was repeated starting with a balloon prepared with asymmetrically weighted sides, achieved by adhering a piece of foil weighing 1.5 grams (the approximate combined weight of the adhesive and image bearing layer) to the side of the balloon opposite the side prepared to receive the image. The resulting balloon floated in a proper, essentially vertical manner.

As required, details of the present invention are disclosed herein. However, it is to be understood that the disclosed embodiments are merely exemplary. Therefore, specific structural and functional details disclosed herein are not to be interpreted as limiting, but merely as a basis for the claims and as a representative basis for teaching one skilled in the art to variously employ the present invention.

What is claimed is:

1. A method for imparting graphics to a substrate, comprising the steps of:

imparting an image to an image transfer sheet comprising an image receptive layer releasably attached to a carrier sheet;

providing a substrate having an adhesive disposed on at least a portion of the surface thereof;

bringing the image receptive layer into contact with the adhesive; and removing the carrier sheet, wherein at least a portion of the image receptive layer remains on the substrate when the carrier sheet is removed,which imparts the graphics to the substrate.

2. The method of claim 1, wherein the adhesive has a patterned surface.

3. The method of claim 2, wherein the patterned surface is adapted to allow the escape of gases from underneath the image receptive layer.

4. The method of claim 2, wherein the pattern comprises one or more arrays of grooves spaced at a frequency from 5 to 300 lines per inch.

5. The method of claims 1, wherein the image receptive layer is brought into contact with the adhesive in conditions under which the image receptive layer bonds more strongly to the adhesive than to the carrier sheet.

6. The method of claim 1, wherein the image receptive layer is transferred to the substrate as an essentially cohesive mass after it is brought into contact with the adhesive.

7. The method of claim 1, wherein the image receptive layer is transferred to the substrate through the application of pressure.

8. The method of claim 1, wherein the image transfer sheet comprises an ink-absorptive layer releasably attached to a carrier sheet, and wherein the image is imparted to the image transfer sheet by way of an inkjet printer.

9. The method of claim 1, further comprising the step of removing the carrier sheet after the image receptive layer is brought into contact with the adhesive.

10. The method of claim 1, wherein said adhesive is covered with a release liner, and wherein the release liner is removed prior to bringing the image receptive layer into contact with the adhesive.

11. The method of claim 1, wherein the substrate is a balloon.

12. The method of claim 11, wherein the combined weight of the adhesive and image bearing layer is sufficiently counterbalanced by asymmetry in the weight of the sides of the balloon such that the balloon floats in a substantially upright manner when the balloon is inflated.

13. The method of claim 11, wherein the balloon is a metallized foil balloon.

14. The method of claim 13, wherein the metallized foil balloon comprises a layer of aluminum bonded to a polymeric layer.

15. The method of claim 14, wherein the polymeric layer comprises a material selected from the group consisting of polyesters, polyamides and polyolefins.

16. A decorated foil balloon produced according to the method of claim 1.

* * * * *

UNITED STATES PATENT AND TRADEMARK OFFICE

CERTIFICATE OF CORRECTION

PATENT NO. : 6,874,421 B2
DATED : April 5, 2005
INVENTOR(S) : Kitchin, Jonathan P.

It is certified that error appears in the above-identified patent and that said Letters Patent is hereby corrected as shown below:

Title page,
Item [56], References Cited, OTHER PUBLICATIONS, second reference, delete "10/061,847" and insert -- 10/277,847 -- therefor.

Column 7,
Line 66, after "cellulosics" insert -- , --.

Column 8,
Line 11, delete "two-diminensional" and insert -- two-dimensional -- therefor.
Line 56, delete "sabsequently" and insert -- subsequently -- therefor.
Line 62, after "such as" insert -- screen --.
Lines 64-65, delete "at al" and insert -- et al -- therefor.

Column 9,
Line 1, after "transfer of" insert -- an --.
Line 4, delete "SCOTH®" and insert -- SCOTCH® -- therefor.

Column 10,
Line 8, delete "at al" and insert -- et al -- therefor.
Line 19, after the last occurrence of "inks" insert -- . --.
Line 22, delete "acordance" and insert -- accordance -- therefor.
Line 25, delete "digit" and insert -- digital -- therefor.
Line 37, delete "SCOTHPRINT®" and insert -- SCOTCHPRINT® -- therefor.
Line 61, delete "maybe" and insert -- may be -- therefor.
Line 65, delete "methedology" and insert -- methodology -- therefor.

Column 11,
Line 3, after "printers" delete "in".
Line 4, delete "lot" and insert -- Jet -- therefor.
Line 47, after "terephthalate" insert -- film --.
Line 50, delete "into" and insert -- integral -- therefor.
Line 51, after "brand" insert -- 810 --.
Line 59, delete "fist" and insert -- flat -- therefor.
Lines 60-61, delete "laminating" and insert -- Laminating -- therefor.

Column 13,
Line 35, after "bringing" insert -- at least a portion of --.
Line 41, delete "removed,which" and insert -- removed, which -- therefor.

UNITED STATES PATENT AND TRADEMARK OFFICE

CERTIFICATE OF CORRECTION

PATENT NO. : 6,874,421 B2
DATED : April 5, 2005
INVENTOR(S) : Kitchin, Jonathan P.

It is certified that error appears in the above-identified patent and that said Letters Patent is hereby corrected as shown below:

Column 14,
Line 4, delete "claims 1" and insert -- claim 1 -- therefor.

Signed and Sealed this

Twenty-third Day of August, 2005

JON W. DUDAS
*Director of the United States Patent and Trademark Office*